United States Patent [19]

Rehn

[11] Patent Number: 4,754,910

[45] Date of Patent: Jul. 5, 1988

[54] PRESS FOR ASSEMBLING A ROOF TRESTLE

[75] Inventor: Kari Rehn, Lahti, Finland

[73] Assignee: Makron OY, Lahti, Finland

[21] Appl. No.: 2,776

[22] Filed: Jan. 13, 1987

[30] Foreign Application Priority Data

Jan. 16, 1986 [FI] Finland ..... 860198

[51] Int. Cl.[4] ..... B27F 7/15

[52] U.S. Cl. ..... 227/152

[58] Field of Search ..... 227/152, 151, 153, 40, 227/41, 45

[56] References Cited

U.S. PATENT DOCUMENTS

| | | | |
|---|---|---|---|
| 3,068,483 | 12/1962 | Moehlenpah et al. | 227/152 X |
| 3,068,484 | 12/1962 | Moehlenpah et al. | 227/152 |
| 3,069,684 | 12/1962 | Moehlenpah et al. | 227/152 |
| 3,100,301 | 8/1963 | Black | 227/152 |
| 3,599,562 | 8/1971 | Hutchens, Sr. | 227/152 X |
| 3,824,919 | 7/1974 | Moehlenpah | 227/152 X |
| 4,453,705 | 6/1984 | McDonald | 227/152 X |

*Primary Examiner*—Paul A. Bell

*Attorney, Agent, or Firm*—Ladas & Parry

[57] ABSTRACT

A press for assembling a roof trestle has an elongated support for positioning a bottom chord of the roof trestle parallel to and an elongated track member longitudinally perpendicular to the length of the support. A slide member is slidable longitudinally on the track member. An articulation device connected to the slide member interconnects one end of each of two supporting members for being at the ridge point of the roof trestle. Two further articulation devices respectively connect opposite ends of the supporting members respectively to carriages for positioning the same at the eaves ends of the roof trestle. Assembly tables on the support and supporting members are movable therealong for supporting the roof trestle chords in the positions parallel to the latter and a press is displaceable to each assembly table for pressing nail plates into the roof trestle chords.

3 Claims, 2 Drawing Sheets

PRESS FOR ASSEMBLING A ROOF TRESTLE

Figure 1:
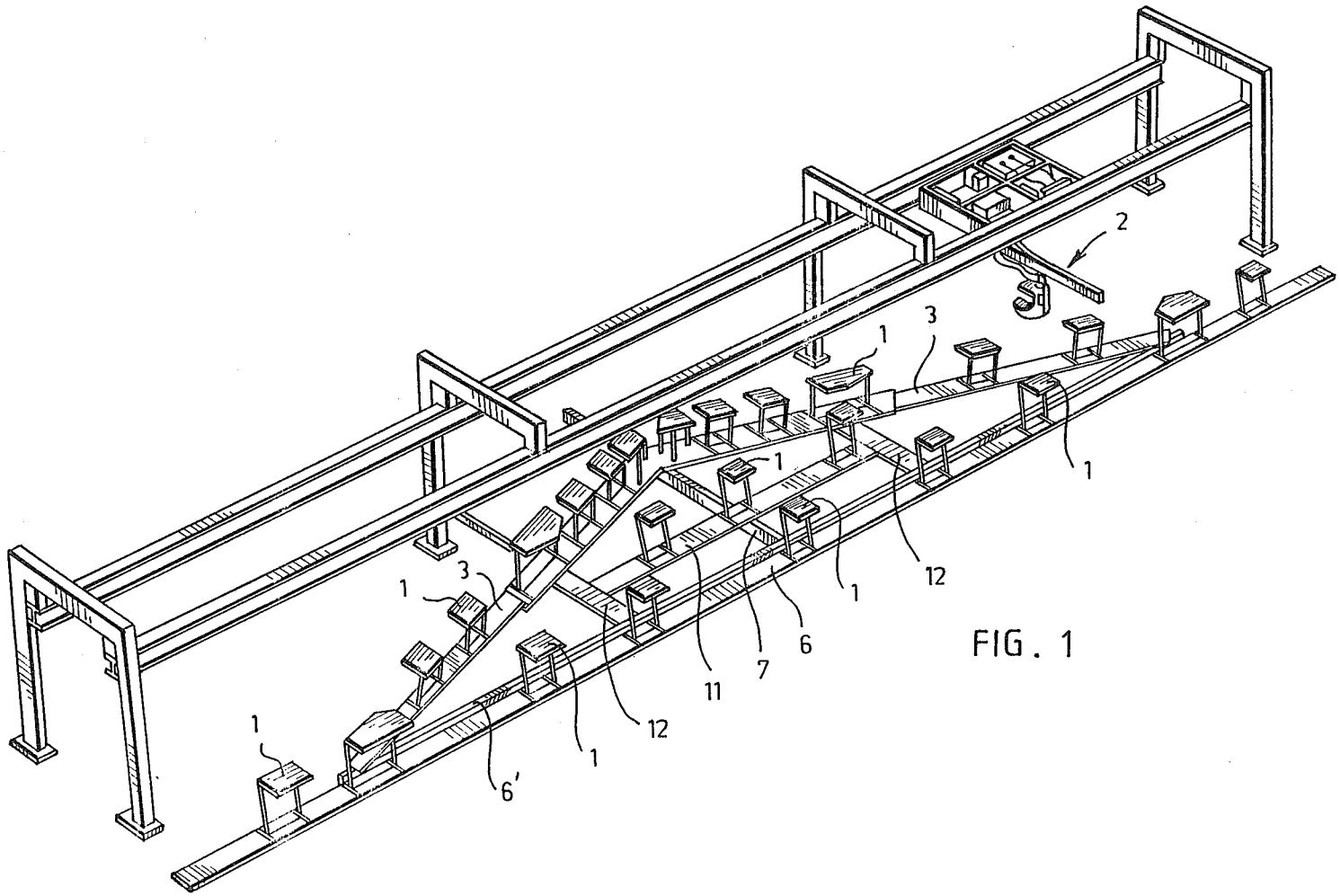

The invention relates to a press for assembling roof trestle.

This kind of device is well known. The idea of a roof trestle press is to assemble various roof trestle frameworks from various sizes of sawed timbers with nail plates. In this, the timbers are supported on assembly tables in positions determined by the shape and dimensions of each roof trestle. The assembly tables are generally supported by suitable supporting means. The different parts of the roof trestle are then interconnected by the press and nail plates.

One example of the prior art is a device employing separate assembly tables which are locked in desired positions by a floor made of steel sheet and electric magnets. One drawback of this solution is that the floor is cold. Another is that the conductors of the electric magnets are positioned on the floor, which increases the security risk. Still another drawback is that the fitting is slow to put together, i.e. positioning the assembly tables at the positions required by the roof trestle takes a lot of time.

Another known prior art solution is a device in which assembly tables are fastened on a beam arrangement. The tables are thereby displaced by the beams and the beams are displaced according to the roof trestle in question. A drawback of this solution is that the beam arrangement is in the way at different stages. Also, the beam arrangement is not easy to lock reliably in place, which increases the risk of an incorrect fitting. A further disadvantage of this device, too, is that the fitting is slow to put together even though, in a certain beam-type solution, the beam device can be arranged or fit according to a pattern for a roof trestle with a measuring tape and sawed roof-trestle timbers.

A common drawback of all the above-mentioned known devices is, therefore, that the fitting is slow to put together. In a normal case, the construction of a new fitting by means of these solutions takes about two to five hours. Thus, it is self-evident that productivity is low if several different kinds of roof trestles are to be constructed.

The object of the invention is to provide a press for roof trestles which eliminates the drawbacks of the prior solutions.

This is achieved by a roof trestle press according to the invention, which is characterized in that supporting members for the ridge-point chords of the roof trestle are interconnected articulately. The articulation is on a slide member connected slideably to a track member extending perpendicular to a support positioned in parallel with the bottom chord of the roof trestle. The supporting members, which similarly extend in parallel with the top chords of the roof trestle are, at points adjacent the eaves ends of the top chords, connected to the support by carriages displaceable in the longitudinal direction of said support.

The device according to the invention is advantageous mainly in that the construction of a new fitting takes about twenty minutes in place of the two to five hours required previously. The device according to the invention can be operated by a small group of workers, e.g. by two men, who can assemble roof trestle in about seven minutes. The device according to the invention can be operated even by one man only and, nevertheless, the results obtained are clearly more advantageous than with prior devices. A roof trestle can be assembled in a shorter time because it is not necessary to tighten the chords against the diagonal bars by means of eccentrics positioned at each assembly table. In addition, the device according to the invention is suitable for use in the manufacture of both hip roof trestles and very small ridge roof trestles, if the device is provided with means required for the manufacture of hip roof trestles. The device according to the invention is also highly advantageous in that it is reliable in operation and easy to maintain. This is due to its simple structure, which is also convenient to the operator.

Figure 2:
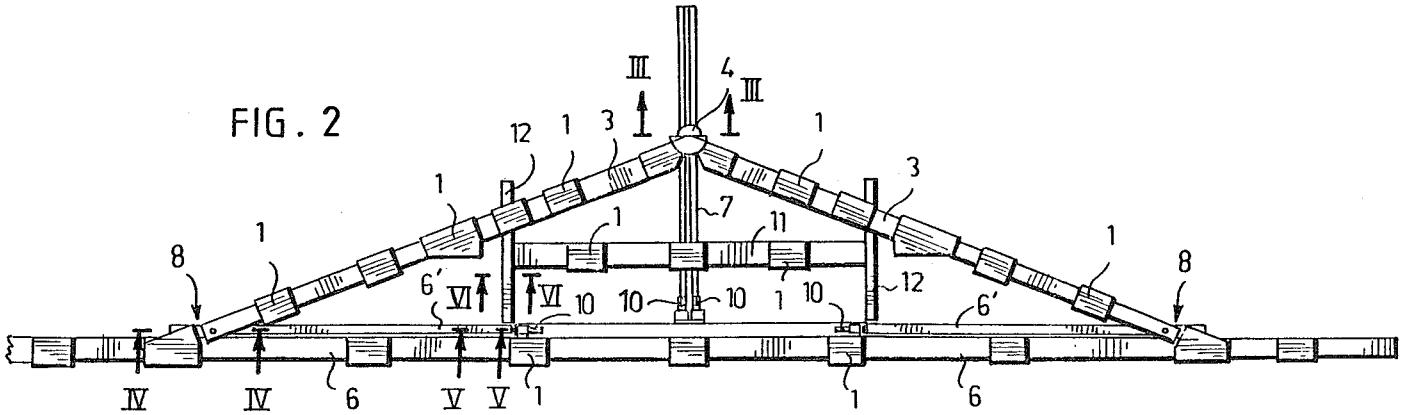
Figure 3:
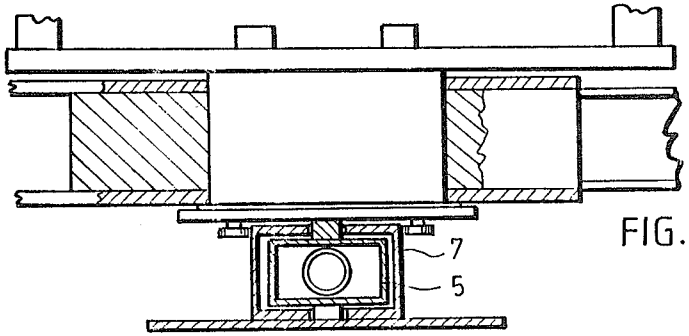
Figure 6:
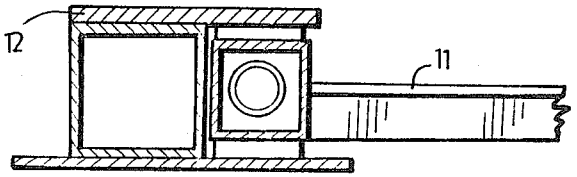
Figure 4:
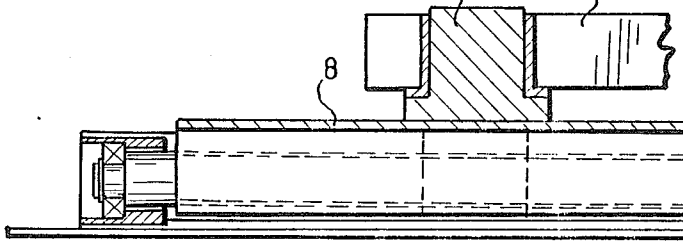
Figure 5:
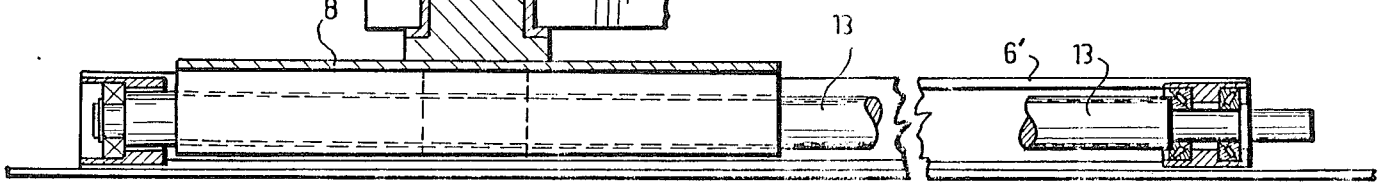

The invention will be described in the following in more detail by means of one preferred embodiment described in the attached drawing, wherein FIG. 1 is a general perspective view of a device according to the invention, FIG. 2 is a top view of the device of FIG. 1, FIG. 3 is a sectional view along the line III—III shown in FIG. 2, FIG. 4 is a sectional view along the line IV—IV shown in FIG. 2, FIG. 5 is a sectional view along the line V—V shown in FIG. 2, and FIG. 6 is a sectional view along the line VI—VI shown in FIG. 2.

FIG. 1 shows assembly tables 1 and a press at 2, which is displaceable to each assembly table 1 for pressing nail plates into top and bottom chords of a roof trestle supported on the assembly tables. The top and bottom chords of the roof trestle are not shown in the figures, because all these matters are completely obvious to one skilled in the art.

According to the invention, ends of two assembly-table supporting members 3 are interconnected at the ridge point of the roof trestle to be assembled by an articulation device 4 (FIG. 2). The articulation device 4 is connected, in turn, to a slide member 5 (FIG. 3) slidable longitudinally of an elongated track member 7 (FIGS. 2 and 3) extending longitudinally perpendicular to the length of an elongated support 6 (FIG. 2) positioned in parallel with the bottom chord of the roof trestle (not shown). Opposite ends of the supporting members 3, which are positiond in parallel with the top chords of the roof trestle (not shown), are connected to the support 6 at points adjacent the eaves ends of the top chords by two, respective carriages 8 (FIGS. 2 and 4). The carriages 8 are displaceable in the longitudinal direction of the support 6 on guides 6' (FIG. 5) thereof. The opposite ends of the supporting members 3 are, therefore, connected to the respective carriages 8 by respective devices articulation 9.

The supporting members 3 provided for the top chords of the roof trestle are preferably telescopic in structure. The slide member 5 and the carriages 8 then can be moved to the positions required by various roof trestles. The movement can be effected, e.g., by motors 10 (FIG. 2) and suitable transmission means, such as screws 13 (one shown in FIGS. 4 and 5). The slide member 5 and carriages 8 can be arranged to move either separately or simultaneously.

The auxiliary equipment required for the manufacture of hip roof trestles is also shown in the FIGS. 1 and 2. For this, the press is provided with a rafter member 11 for the hip rafter (not shown) of the hip roof trestle. The rafter member 11 is positioned in parallel with the support 6, which is parallel to the bottom chord of the roof trestle, and provided with assembly tables 1. Further, the rafter member 11 is displaceable on guide members 12 thereof, independently of the supporting members 3 and 6, in the longitudinal direction of the track member 7, as appears from FIG. 2. The rafter member may be so displaced in the same way as the other supporting means, i.e. separately or simultaneously with the slide member 5 and carriages 8. The displacement of both the slide member 5 and the rafter member 11 can be effected, e.g., by a screw member (not shown) and motor 10 in a similar way to that described above in connection with the carriages 8.

The idea of the invention is that, when a fitting is constructed, correct positions for the assembly tables 1 can be obtained rapidly, merely by displacing the supporting members 3 and possibly the rafter member 11 to the right positions and displacing the assembly tables 1, which are movable along the supporting members 3, support 6, and rafter member 11, to desired positions, whereby the construction of the roof trestle can be carried out rapidly. The main features of the operation of the device can be described in the following way.

The construction of a new fitting (roof trestle configuration) takes place semi-automatically. An operator punches the keys of a control unit (not shown) to produce the desired ridge height, with the accuracy of one millimeter on a display screen, and presses a start button to move the slide member 5 and its articulation 4 to the corresponding ridge-point position also with the accuracy of one millimeter. When the operator correspondingly punches in the desired angle of inclination of both top chords to an accuracy of two decimals, and presses a start button therefor, the eaves points, i.e. the carriages 8, are accurately displaced to the right positions.

In a corresponding way, the rafter member 11 ca be displaced accurately to a desired position.

All the above operations can, of course, also be carried out partly or wholly simultaneously.

After these steps, the position and dimensions of the supporting members 3, support 6, and, if applicable, rafter member 11 accurately correspond to the shape and dimensions of the desired roof trestle.

Thereafter the assembly tables 1 are displaced manually to the connection points of the chords and any diagonal bars for the roof trestle. The assembly tables move easily on wheels (not shown) along shallow steel guides (not shown) of the supporting members and support, and they are locked in place by turning handles (not shown) provided on the tables. The shallow steel guides are provided with measuring scales (not shown), by means of which the right positions of the tables can be found rapidly. The assembly tables are also provided with a measuring scale by means of which the right position for a nail plate to be put thereon can be determined. Adjustable guides (not shown) at the edges of the assembly tables are also positioned so that the chords and diagonal bars can be rapidly positioned in place.

After the new fitting is completed, the ridge point and the eaves points are driven outwards to some extent, e.g. about 5 mm, in order to enlarge the fitting. The fitting is thus provided with suitable clearances. Thereafter, the fitting is driven to its proper size and the topmost nail plates are positioned in place.

In tightening, the timbers are supported on the guides provided on the assembly tables 1, and the assembly tables 1 are correspondingly supported on the supporting members 3 and support 6 extending in parallel with the bottom chord. The tightening ensures the dimensional stability of the roof trestle and provides tight contact between the timbers thereof at their joints.

Thereafter, each pair of nail plates, in turn, is pressed fast into the timbers by the press at 2, which may be, e.g., a C-press.

After the roof trestle is completed, the fitting is driven outwards to some extent, so that the roof trestle can be lifted off, and the device is ready for the construction of a new roof trestle.

The above example is by no means intended to restrict the invention; the invention can be modified within the scope of the claims in various ways. Accordingly, for example, the slide member and the carriages can be displaced by any suitable transmission means, such as a screw, a chain, a cogged belt, etc. The determination of the right position can also be effected by means of any suitable device, e.g. by means of a pulse detector which counts the revolutions of the screw. Said displacement can, of course, be controlled by means of any system suited for the purpose. Naturally, it is also possible to adjust the ridge height by displacing the supporting means 6 in the same way as the rafter member 11. The structure of the supporting members 3 does not need to be telescopic, either; instead, the supporting members can be integral beams which slide at the joint points, i.e. at the ridge and the eaves points, in the longitudinal direction thereof.

What is claimed is:

1. A press for assembling a roof trestle, the press comprising:

an elongated support for positioning a bottom chord of a roof trestle parallel to;

an elongated track member longitudinally perpendicular to the length of the support;

a slide member slidable longitudinally on the track member;

two supporting members for positioning respective top chords of the roof trestle parallel to;

an articulation device connected to the slide member and interconnected one end of each of the supporting members for being at the ridge point of the roof trestle;

two carriages displaceable longitudinally along the support;

two further articulation devices respectively connecting opposite ends of the supporting members respectively to the carriages for positioning the same at the eaves ends of the roof trestle;

assembly tables on the support and supporting members and movable therealong for supporting the roof trestle chords in the positions parallel to the latter; and a press displaceable to each assembly table for pressing nail plates into the roof trestle chords.

2. The press according to claim 1, wherein the supporting members are telescopic in structure.

3. The press according to claim 1, and further comprising: a rafter member parallel to the support and having guide members for displacing the rafter member longitudinally of the track member; and assembly tables on the rafter member for supporting a hip rafter.

* * * * *